United States Patent [19]

McCoy

[11] 4,009,872

[45] Mar. 1, 1977

[54] ENERGY-CONSERVING, FAST-COOLING HEAT TREATING FURNACE

[75] Inventor: John F. McCoy, Rockford, Ill.

[73] Assignee: Alco Standard Corporation, Valley Forge, Pa.

[22] Filed: June 25, 1976

[21] Appl. No.: 699,951

[52] U.S. Cl. ..... 266/250

[51] Int. Cl.[2] ..... C21D 1/00

[58] Field of Search ..... 432/83; 266/249–254, 266/257, 259; 148/13, 143, 144

[56] References Cited

UNITED STATES PATENTS 3,301,541 1/1967 Ipsen ..... 266/250

*Primary Examiner*—Gerald A. Dost

*Attorney, Agent, or Firm*—Leydig, Voit, Osann, Mayer & Holt, Ltd.

[57] ABSTRACT

A heat treating furnace includes a vessel formed by inner and outer spaced apart walls, there being a hollow jacket between the walls. During the heating cycle, a vacuum is maintained in the jacket to reduce heat loss from the vessel and to keep the outer wall cool to the touch. During the cooling cycle, liquid is circulated through the jacket to cool the inner wall and to cool quenching gas being circulated within the vessel.

4 Claims, 1 Drawing Figure

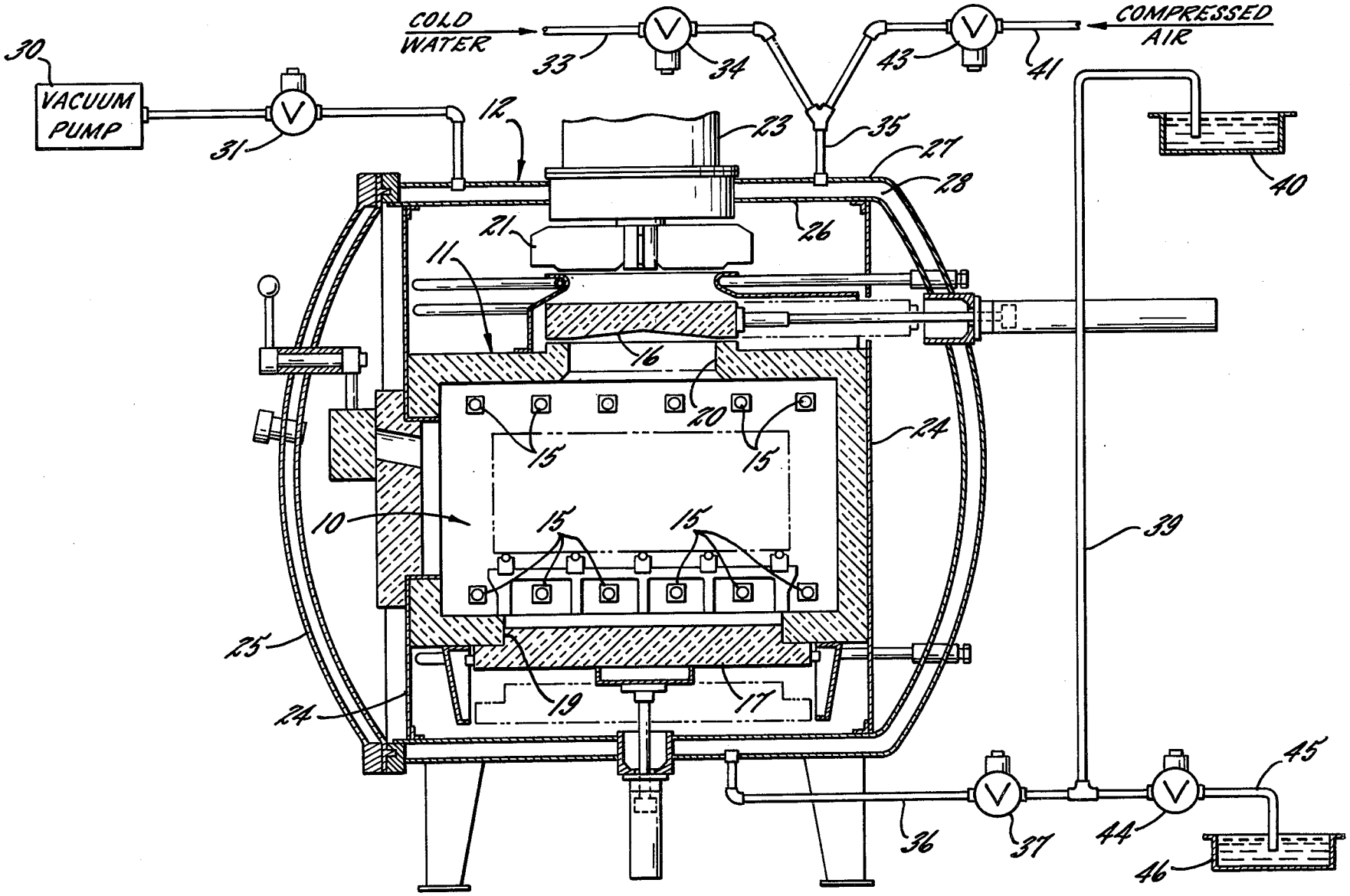
COMPRESSED AIR
COLD WATER
VACUUM PUMP
10
11
12
15
16
17
19
20
21
23
24
25
26
27
28
30
31
33
34
35
36
37
39
40
41
43
44
45
46

ENERGY-CONSERVING, FAST-COOLING HEAT TREATING FURNACE

BACKGROUND OF THE INVENTION

This invention relates in general to a heat treating furnace of the type which includes a vessel defining a chamber for holding workpieces, there being heating elements within the chamber to heat the workpieces. More particularly, the invention relates to a furnace in which a quenching gas is circulated through the chamber at the end of the heating cycle for the purpose of cooling the workpieces prior to the workpieces being removed from the chamber.

A furnace of this general type is disclosed in Ipsen U.S. Pat. No. 3,301,541. In that furnace, the vessel is formed by inner and outer spaced apart walls which define a hollow jacket around the heating chamber. During the heating cycle, liquid is circulated through the jacket to keep the outer wall of the vessel cool to the touch. During the cooling cycle, the circulating liquid cools the inner wall of the jacket and also cools the quenching gas within the chamber so as to promote faster cooling of the workpieces.

More than a year prior to the filing date of this application, the assignee of the present invention developed and sold a heat treating furnace which from a structural standpoint, is very similar to that disclosed in the aforementioned Ipsen patent. That is, the furnace which was sold included a vessel having inner and outer walls defining a jacket, heating elements for heating the workpieces in the vessel, and means for circulating a quenching gas within the vessel to cool the workpieces. In that furnace, however, liquid is never circulated through the jacket but instead a vacuum is maintained in the jacket. The vacuum reduces the transmission of heat from the inner wall to the outer wall and thus not only serves to keep the outer wall cool to the touch but also serves to reduce heat losses from the chamber via the walls so as to conserve heat energy.

SUMMARY OF THE INVENTION

The general aim of the present invention is to provide a new and improved furnace of the above type in which the jacket around the vessel is utilized in a unique manner so as to conserve heat energy, to maintain the outer wall of the vessel cool to the touch and, at the same time, to promote fast cooling of the workpieces.

A more detailed object is to achieve the foregoing by providing a furnace in which a vacuum is maintained in the jacket during the heating cycle and in which liquid is circulated through the jacket during the cooling cycle. The vacuum keeps the outer wall cool to the touch while permitting less heat loss from the vessel than is the case when liquid is circulated through the jacket during the heating cycle. By circulating liquid through the jacket during the cooling cycle, more heat is removed from the quenching gas and the workpieces than is the case when a vacuum is maintained in the jacket during the cooling cycle.

Still other objects of the invention are to insure that the jacket is completely filled with liquid during the cooling cycle and to quickly drain the liquid from the jacket at the end of the cooling cycle.

These and other objects and advantages of the invention will become more apparent from the following detailed description when taken in conjunction with the accompanying drawings.

BRIEF DESCRIPTION OF THE DRAWINGS

The SINGLE FIGURE of the drawing is a fragmentary longitudinal cross-sectional view of a furnace embodying the novel features of the present invention, certain aspects of the furnace being shown schematically.

DETAILED DESCRIPTION OF THE PREFERRED EMBODIMENT

As shown in the drawings for purposes of illustration, the invention is embodied in a furnace for heating metal workpieces in a chamber 10 formed by a box-like enclosure 11 disposed within a horizontal, vacuum-tight outer vessel 12, and for subsequently cooling or quenching the workpieces in the work chamber to obtain certain desirable physical properties of the metal. To protect the finish of the workpieces, they are heated in a protective atmosphere, usually a vacuum created by a suitable pumping apparatus (not shown) that communicates with the interior of the vessel. The work is quenched in a flow of non-oxidizing gas admitted into the vessel from a pressurized tank (not shown) at the end of the heating cycle.

The furnace itself is very similar to the furnace disclosed in FIGS. 1 and 2 of the aforementioned Ipsen patent. Reference may be had to that patent for details of construction and thus the present description will explain only so much of the furnace as is necessary for an understanding of the present invention.

In brief, the workpieces are adapted to be heated by a plurality of conventional radiant heating elements 15 disposed within the enclosure 11 and adapted to be selectively energized from a voltage source. When the heating cycle is finished, upper and lower bungs 16 and 17 are opened to uncover an inlet port 19 and an outlet port 20 formed in the enclosure 11. Quenching gas then is circulated through the enclosure by a fan 21 supported by the vessel 12 above the outlet port and adapted to be driven by a motor 23. When the fan is in operation, it forces gas outwardly away from the outlet port 20 in all directions. Deflector plates 24 extend from the outside of the enclosure 11 to the inner side of the vessel 12 at the front and rear ends of the enclosure so as to direct all of this gas downwardly along the inner side of the vessel and around the enclosure toward the inlet port 19. Thus, the fan induces a flow of gas around the vessel and upwardly through the inlet port 19 and the work chamber 10.

In the present instance, the vessel is substantially cup-shaped and includes a cylindrical body whose rear end is closed by an integral dome. The forward end of the body is closed by a dome-shaped door 25 which may be opened to permit workpieces to be loaded into and removed from the work chamber 10. The body and the integral dome of the vessel 12 are formed by inner and outer walls 26 and 27 which are spaced apart so as to define a hollow jacket 28 between the walls. In accordance with the present invention, a vacuum is maintained in the jacket 28 between the inner and outer walls 26 and 27 of the vessel 12 during the heating cycle and only during the heating cycle. As a result of the vacuum in the jacket, heat transmission from the inner wall to the outer wall is reduced so as to conserve heat energy and, at the same time, to keep the outer wall cool to the touch. Further in carrying out the invention, liquid is circulated through the jacket 28 during the cooling cycle and serves to cool the inner wall 26 and the quenching gas which is circulated around the inner wall. Thus, the present furnace reduces heat losses through the walls 26 and 27 during the heating cycle and yet promotes rapid cooling of the workpieces during the cooling cycle.

More specifically, the vacuum is established within the jacket 28 by a vacuum pump 30 which communicates with the jacket via a selectively operable valve 31. During the heating cycle, the valve 31 is opened so that the air in the jacket may be evacuated by the pump. When the jacket is evacuated, the vessel 12 is much like a vacuum bottle in that conductive and convective heat transmission between the inner and outer walls 26 and 27 is reduced. The temperature of the inner wall 26 rises to approximately the same temperature as the outer side of the enclosure 11 and, when a state of near equilibrium is approached, very little heat is radiated from the enclosure to the inner wall. The inner wall is cooled only by heat transfer between the inner wall and the outer wall and, because of the evacuated jacket 28, such heat transfer can take place only by radiation. Accordingly, the inner wall 26 remains at about the same temperature as the outer side of the enclosure 11 and thus there is less heat loss through the inner wall than is the case when the inner wall is cooled by circulating liquid through the jacket 28 during the heating cycle. At the same time, the outer wall 27 remains relatively cool because the vacuum in the jacket retards the transmission of heat between the inner and outer walls.

At the completion of the heating cycle, the vacuum is released from the jacket 28 and the latter is filled with liquid such as cold water. For this purpose, a line 33 leading from a water pump (not shown) communicates with the top of the jacket 28 by way of a selectively operable valve 34 and a line 35. Another line 36 leads out of the lower side of the jacket and connects with a valve 37 which, in turn, is connected to yet another line 39 leading to a drain 40. In carrying out the invention, the drain 40 is disposed in a location which is as high as or higher than the highest part of the outer wall 27 so as to insure that the jacket 28 will be completely filled with circulating cold water throughout the entire height of the jacket. The water thus introduced into the jacket cools the inner wall 26 and the quenching gas flowing around the inner wall and carries away heat from the gas so as to promote faster cooling of the workpieces than is effected when a vacuum is maintained in the jacket during the cooling cycle.

After one work load has been cooled, the jacket 28 must be purged of water prior to the start of the next heating cycle. This is achieved in a relatively short time by introducing compressed air from a line 41 into the line 35 and the jacket 28 under the control of a valve 43. During purging of the jacket 28, a valve 44 is opened and establishes communication between the line 36 and a line 45 leading to a second drain 46 which is located as low as or lower than the lowest part of the outer wall 27. Thus, all of the water can be forced quickly from the jacket 28 to the drain 46 in order to enable the next heating cycle to begin in a relatively short time. It will be understood that the valve 31 is the only valve which is open during the heating cycle, that the valves 34 and 37 are the only valves which are open during the cooling cycle, and that the valves 37, 43 and 44 are the only valves which are open during the purging cycle.

From the foregoing, it will be apparent that the present invention brings to the art a new and improved furnace in which a vacuum is maintained in the jacket 28 during the heating cycle to conserve heat energy while liquid is circulated through the jacket during the cooling cycle in order to effect fast cooling of the workpieces. Accordingly, the present furnace possesses advantages not found in prior art furnaces.

I claim:

1. A heat treating furnace comprising a vessel defining a chamber for holding workpieces, selectively operable heating elements located within said chamber for heating said workpieces, selectively operable means for circulating a quenching gas within said chamber to cool said workpieces, at least part of said vessel being formed by inner and outer spaced apart walls defining a hollow jacket around at least part of said chamber, means for creating a vacuum within said jacket while said workpieces are being heated thereby to reduce heat transmission from said inner wall to said outer wall and to keep the latter wall comparatively cool, and means for circulating liquid through said jacket while said workpieces are being cooled by said quenching gas whereby said liquid cools said inner wall and said quenching gas to promote fast cooling of said workpieces.

2. A heat treating furnace as defined in claim 1 further including a drain, and means for discharging into said drain the liquid circulated through said jacket, said drain being located above said vessel to insure that said jacket is filled with liquid throughout substantially the entire height of the jacket when said liquid is being circulated through said jacket.

3. A heat treating furnace as defined in claim 2 further including a second drain, means for selectively discharging said liquid from said jacket into said second drain, said second drain being located below said vessel to facilitate the discharge of liquid from said jacket, and means for selectively introducing pressurized gas into said jacket to rapidly force said liquid from said jacket and into said second drain.

4. A heat treating furnace as defined in claim 1 further including a drain, means for selectively discharging said liquid from said jacket into said drain, and means for selectively introducing pressurized gas into said jacket to rapidly force said liquid from said jacket and into said drain.

* * * * *